US007284482B2

(12) United States Patent
Inoue et al.

(10) Patent No.: US 7,284,482 B2
(45) Date of Patent: Oct. 23, 2007

(54) SHEET-FED OFFSET ROTARY PRINTING PRESS WITH CONVERTIBLE PRESS MECHANISM

(75) Inventors: Seiichiro Inoue, Ibaraki (JP); Shigeru Maruyama, Ibaraki (JP)

(73) Assignee: Komori Corporation, Tokyo (JP)

( * ) Notice: Subject to any disclaimer, the term of this patent is extended or adjusted under 35 U.S.C. 154(b) by 202 days.

(21) Appl. No.: 11/291,182

(22) Filed: Nov. 30, 2005

(65) Prior Publication Data

US 2006/0112842 A1 Jun. 1, 2006

(30) Foreign Application Priority Data

Dec. 1, 2004 (JP) ..... 2004-348551
Dec. 22, 2004 (JP) ..... 2004-370766

(51) Int. Cl.
*B41F 5/02* (2006.01)

(52) U.S. Cl. ..... 101/230; 271/186

(58) Field of Classification Search ..... 101/177, 101/183, 184, 230, 231, 232, 409; 271/184, 271/186, 902
See application file for complete search history.

(56) References Cited

U.S. PATENT DOCUMENTS 5,156,090 A * 10/1992 Wirz ..... 101/142
5,413,040 A 5/1995 Sugiyama et al.
5,706,726 A * 1/1998 Stephan ..... 101/232
6,470,798 B1 * 10/2002 Hiwatashi et al. ..... 101/231
7,207,265 B2 * 4/2007 Helmstadter ..... 101/230
2003/0121433 A1 * 7/2003 Helmstadter et al. ..... 101/230

* cited by examiner

*Primary Examiner*—Ren Yan
(74) *Attorney, Agent, or Firm*—Blakely, Sokoloff, Taylor & Zafman

(57) ABSTRACT

A sheet-fed offset rotary printing press with a convertible press mechanism includes a chucking cylinder, convertible cylinder, grippers, and air nozzles and blowing ports. The chucking cylinder conveys a sheet by holding its leading edge. The convertible cylinder is arranged downstream of the chucking cylinder in a sheet convey direction and holds a trailing edge of the sheet being conveyed by the chucking cylinder. The grippers cause the convertible cylinder to hold the sheet in a turned state when the sheet is to be transferred from the chucking cylinder to the convertible cylinder. The air nozzles and blowing ports are arranged at different heights on outer sides of two ends in a widthwise direction of the sheet, and blow air toward a center in the widthwise direction of the sheet which is turned over by the grippers, so as to separate the sheet from the chucking cylinder.

11 Claims, 5 Drawing Sheets

SHEET-FED OFFSET ROTARY PRINTING PRESS WITH CONVERTIBLE PRESS MECHANISM

BACKGROUND OF THE INVENTION

The present invention relates to a sheet-fed offset rotary printing press with a convertible press mechanism which turns a sheet over when the sheet is to be gripping-changed from an upstream transport cylinder to a downstream transport cylinder in a sheet convey direction to perform double-sided printing.

In a sheet-fed offset rotary printing press with a convertible press mechanism of this type, a sheet which has been conveyed with its leading edge being gripped by the grippers of an upstream transport cylinder in the sheet convey direction is not gripping-changed, when the grippers of the upstream transport cylinder oppose a downstream transport cylinder, and passes by the downstream transport cylinder. After that, when the trailing edge of the sheet opposes the downstream transport cylinder, it is gripped by the grippers of the downstream transport cylinder. In this state, the downstream transport cylinder continues rotation, and the grippers of the upstream transport cylinder release the sheet, to turn the sheet over. At this time, if the sheet stays in tight contact with the surface of the upstream transport cylinder and does not separate from it, the sheet may be damaged, or a gripping-change error occurs. In order to prevent this, air is blown to the upstream transport cylinder so that the sheet is separated from the surface of the upstream transport cylinder.

A conventional sheet-fed offset rotary printing press with a convertible press mechanism comprises an air blowing means fixed inside a notch in a convertible cylinder, as shown in U.S. Pat. No. 5,413,040. When a sheet is to be gripping-changed from an impression cylinder to the convertible cylinder, air is blown to the gap between the outer surface of the impression cylinder and the sheet to be separated from the outer surface of the impression cylinder, so as to separate the sheet which is in tight contact with the outer surface of the impression cylinder.

In the conventional sheet-fed offset rotary printing press with the convertible press mechanism described above, the air blowing means is fixed in the notch of the convertible cylinder. As the convertible cylinder rotates, the air blowing means also rotates to change the air blowing direction. This shortens the blowing time of the air from the air blowing means toward the sheet, so the quantity of air blown to the sheet becomes insufficient. The sheet thus stays in tight contact with the impression cylinder and cannot be reliably separated from the outer surface of the impression cylinder. The air blowing means is integrally rotated with the convertible cylinder. Thus, a hose or the like to supply air from an air source to the air blowing means must be provided in the convertible cylinder. This complicates the structure.

SUMMARY OF THE INVENTION

It is an object of the present invention to provide a sheet-fed offset rotary printing press with a convertible press mechanism which can reliably separate a sheet, which is to be gripping-changed from an upstream transport cylinder to a downstream transport cylinder, from the surface of the upstream transport cylinder.

In order to achieve the above object, according to the present invention, there is provided a sheet-fed offset rotary printing press with a convertible press mechanism, comprising an upstream transport cylinder which conveys a sheet by holding a leading edge thereof, a downstream transport cylinder which is arranged downstream of the upstream transport cylinder in a sheet convey direction and holds a trailing edge of the sheet being conveyed by the upstream transport cylinder, a convertible press mechanism which causes the downstream transport cylinder to hold the sheet in a turned state when the sheet is to be transferred from the upstream transport cylinder to the downstream transport cylinder, and a pair of air blowing means, arranged at different heights on outer sides of two ends in a widthwise direction of the sheet, for blowing air toward a center in the widthwise direction of the sheet which is turned over by the convertible press mechanism, so as to separate the sheet from the upstream transport cylinder.

DESCRIPTION OF THE PREFERRED EMBODIMENT

A sheet-fed offset rotary printing press with a convertible press mechanism according to an embodiment of the present invention will be described with reference to FIGS. 1 to 5.

Figure 1:
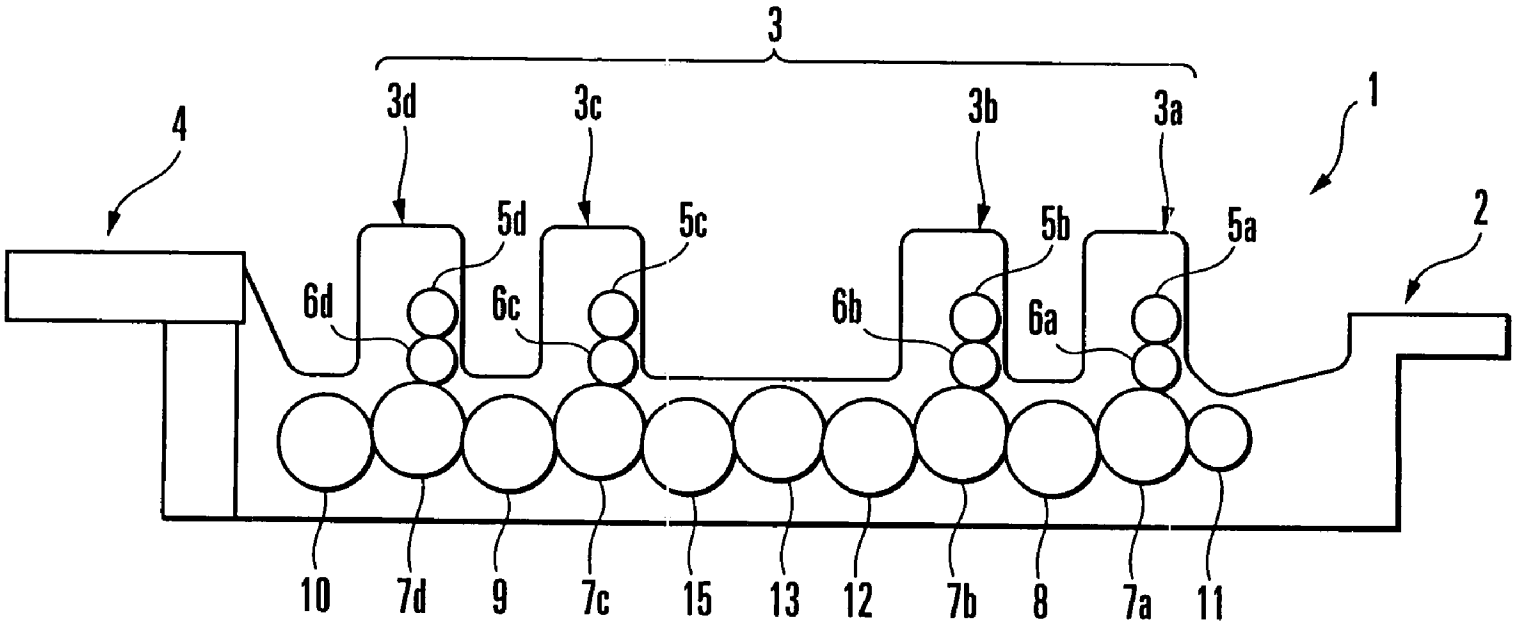
FIG. 1 is a schematic view showing the arrangement of a sheet-fed offset rotary printing press with a convertible press mechanism according to an embodiment of the present invention.

As shown in FIG. 1, a four-color printing press 1 with a convertible press mechanism according to this embodiment comprises a feed device 2 which supplies sheets, a printing device 3 composed of printing units 3*a* to 3*d* which respectively print with first to fourth colors, and a delivery device 4 which delivers a printing product conveyed from the printing device 3. The printing units 3*a* to 3*d* respectively comprise plate cylinders 5*a* to 5*d*, blanket cylinders 6*a* to 6*d* with outer surfaces in contact with those of the plate cylinders 5*a* to 5*d*, and impression cylinders 7*a* to 7*d* with outer surfaces in contact with those of the blanket cylinders 6*a* to 6*d*. A transfer cylinder 8 is interposed between the impression cylinders 7*a* and 7*b*, and a transfer cylinder 9 is interposed between the impression cylinder 7*c* and 7*d*.

A transfer cylinder 12, a chucking cylinder 13 serving as an upstream transport cylinder, and a convertible cylinder 15 serving as a downstream transport cylinder with a convertible press mechanism are interposed between the impression cylinder 7*b* of the second-color printing unit 3*b* and the impression cylinder 7*c* of the third-color printing unit 3*c*. A delivery cylinder 10 is arranged between the impression cylinder 7*d* and delivery device 4 to be in contact with the impression cylinder 7*d*, and supplies a sheet printed by the printing unit 3*d* to the delivery device 4. A transfer cylinder 11 is arranged between the feed device 2 and printing unit 3*a* to be in contact with the impression cylinder 7*a*, and adjusts registration of the surface of a sheet received from a swing device (not shown).

When the convertible press mechanism of the convertible cylinder 15 is set in an inoperative state, the printing press 1 performs single-sided printing of printing patterns of four different colors on the obverse surface of a sheet fed from the feed device 2 to the printing device 3. When the convertible press mechanism of the convertible cylinder 15 is set in an operative state, the printing press 1 performs double-sided printing. Namely, after the printing units 3*a* and 3*b* print the patterns of the two different colors on the obverse surface of the sheet, the sheet is turned over by the convertible cylinder 15. Then, the printing units 3*c* and 3*d* print patterns of two different colors on the reverse surface of the sheet. The sheet printed by the printing device 3 is delivered to the delivery device 4.

Figure 3:
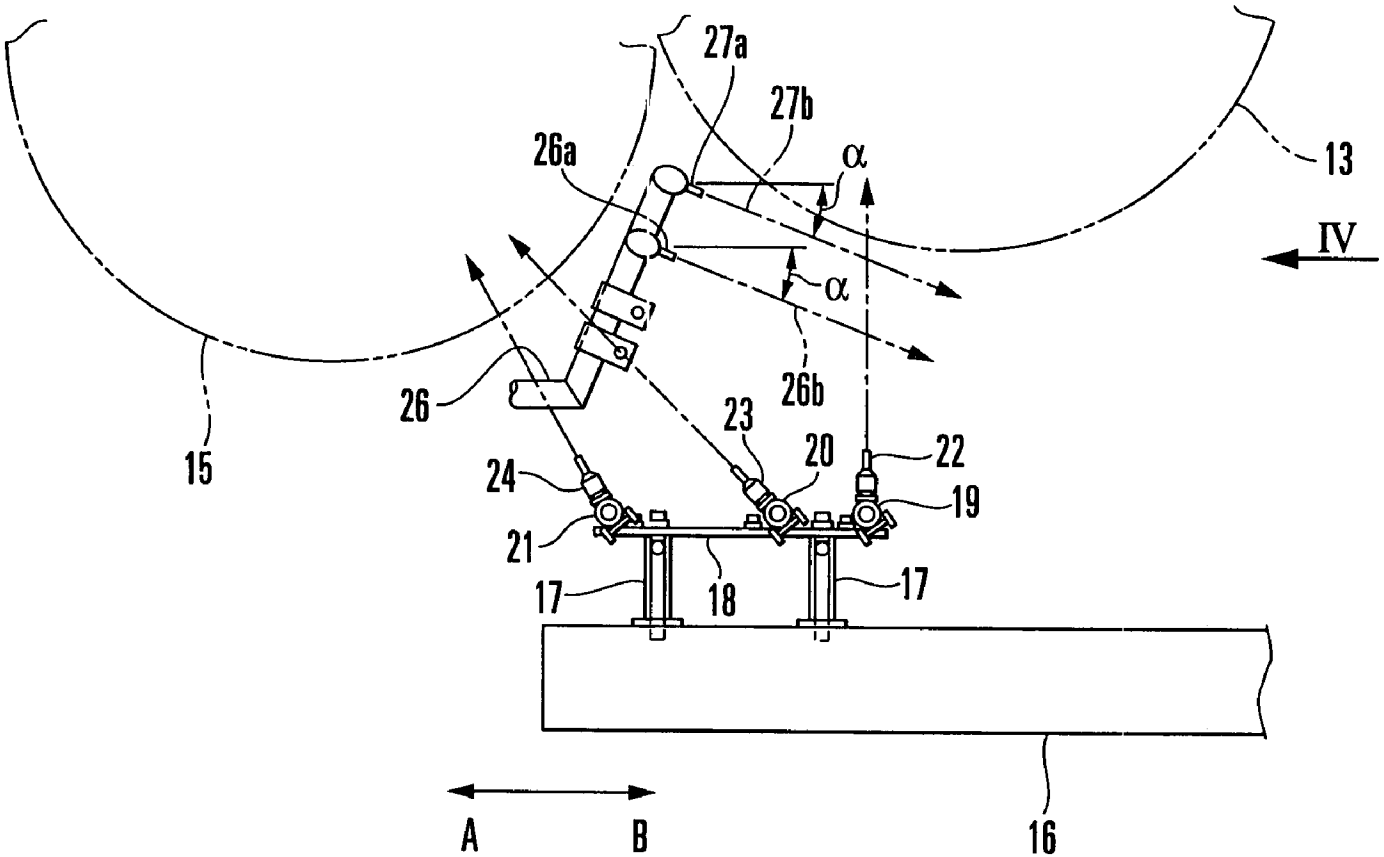
FIG. 3 is an enlarged side view of the chucking cylinder and convertible cylinder shown in FIG. 1.

As shown in FIG. 3, a pair of support plates 18 are attached to a machine base 16 of the printing press 1 through studs 17 to correspond to the two ends of the convertible cylinder 15. Three air pipes 19, 20, and 21, to which positive pressure air from an air source is supplied, extend horizontally between the support plates 18. The air pipes 19, 20, and 21 respectively have a plurality of air nozzles 22, 23, and 24 equidistantly in the axial direction to blow air. Of the air nozzles, the air nozzle 22 has an air blowing direction that is set toward the chucking cylinder 13, and the air nozzles 23 and 24 have air blowing directions that are set toward the center of the convertible cylinder 15.

Figure 2:
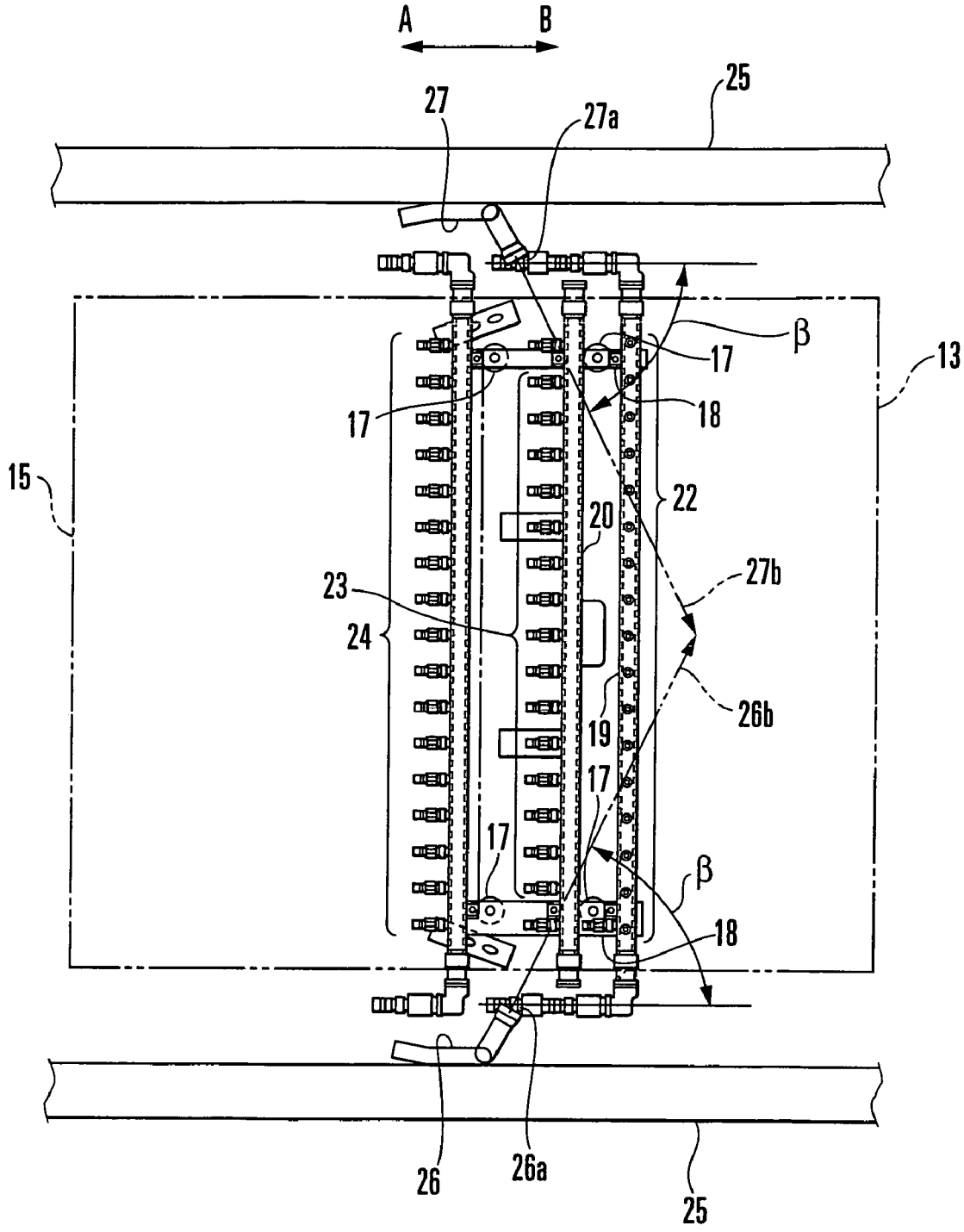
FIG. 2 is an enlarged plan view of the chucking cylinder and convertible cylinder shown in FIG. 1.
Figure 5:
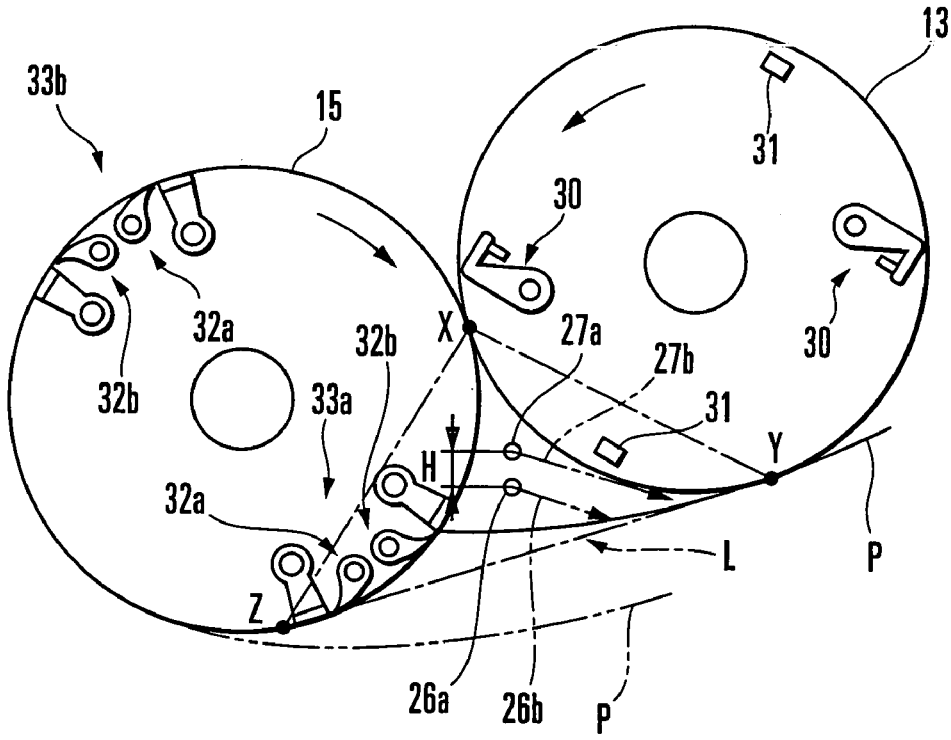
FIG. 5 is a view for explaining an operation of separating a turned sheet from the surface of the chucking cylinder in the sheet-fed offset rotary printing press with the convertible press mechanism shown in FIG. 1.
Figure 6:
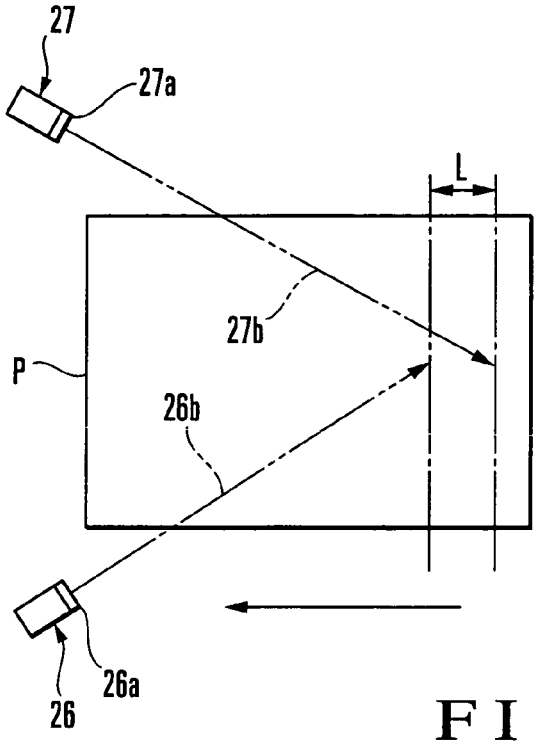
FIG. 6 is a view for explaining the separating operation shown in FIG. 5 in detail.
Figure 7:
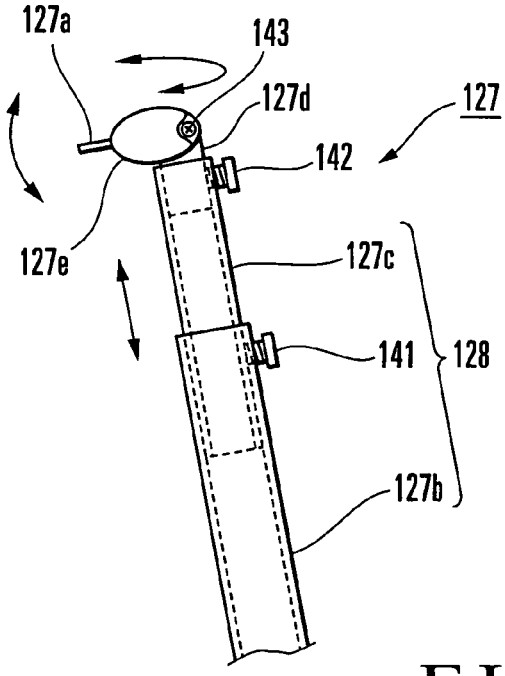
FIG. 7 is a view showing a modification of an air nozzle.

Referring to FIG. 2, air nozzles 26 and 27 (air blowing means), to which positive pressure air is supplied from the air source (not shown), are respectively attached to a pair of frames 25 which axially support the chucking cylinder 13, convertible cylinder 15, and the like rotatably. The air nozzles 26 and 27 respectively have blowing ports 26*a* and 27*a* arranged on the outer sides of the two ends of each of the chucking cylinder 13 and convertible cylinder 15. Therefore, the blowing ports 26*a* and 27*a* of the air nozzles 26 and 27 are located outside the two ends in the widthwise direction of, among sheets that are being conveyed, a sheet that has the maximal width. As shown in FIG. 5, the blowing ports 26*a* and 27*a* of the air nozzles 26 and 27 are arranged to correspond to a triangular sectional region surrounded by an opposing point X, where the chucking cylinder 13 and convertible cylinder 15 oppose each other, and contact points Y and Z downstream of the opposing point X of the chucking cylinder 13 and convertible cylinder 15 in the sheet convey direction. At the contact point Y, the chucking cylinder 13 is in contact with a common tangent L which connects the outer surfaces of the chucking cylinders 13 and convertible cylinder 15. At the contact point Z, the convertible cylinder 15 is in contact with the common tangent L. The air nozzles 26 and 27 blow air toward the center of the sheet through the triangular sectional region.

Figure 4:
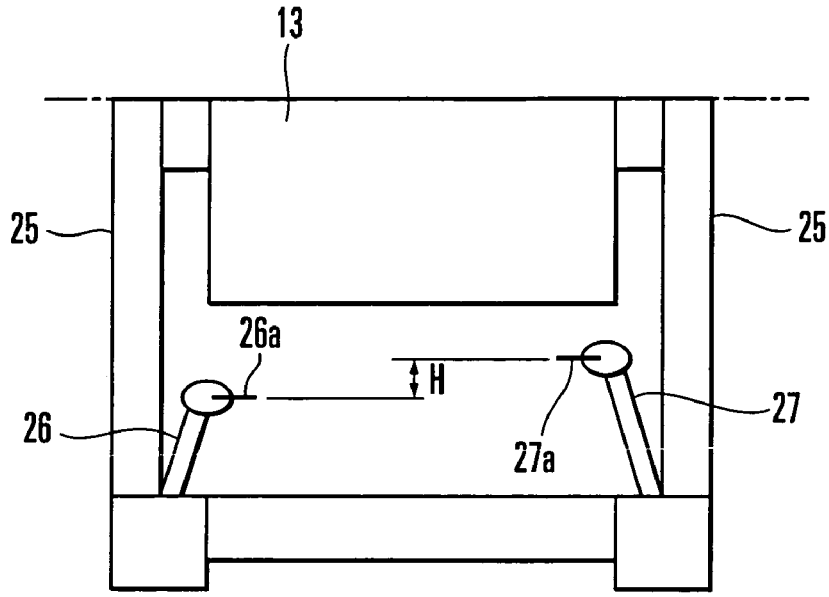
FIG. 4 is a view seen from a direction of an arrow IV of FIG. 3.

As shown in FIG. 4, the blowing port 27*a* of the air nozzle 27 is arranged higher than the blowing port 26*a* of the air nozzle 26 by a height "H" in the vertical direction. When seen from the side, the air blowing directions from the blowing ports 26*a* and 27*a* are set in advance to be inclined by an angle $\alpha$ downward (vertically) from the horizontal direction, as shown in FIG. 3. Thus, air 26*b* and air 27*b* from the blowing ports 26*a* and 27*a* are blown out to the gap between the outer surface of the chucking cylinder 13 and a paper sheet P which is being separated from the outer surface of the chucking cylinder 13.

When seen from above, the air blowing directions from the blowing ports 26*a* and 27*a* are set to be inclined inwardly by a predetermined angle (horizontally) toward the chucking cylinder 13, as shown in FIG. 2. More specifically, when seen from above, the blowing directions of the air 26*b* and air 27*b* from the blowing ports 26*a* and 27*a* are set to be inclined by an angle $\beta$ from a direction of an arrow B toward the center of the chucking cylinder 13. Thus, the air 26*b* and air 27*b* from the blowing ports 26*a* and 27*a* are blown out from the outer sides of the two ends in the widthwise direction of, among sheets that are being conveyed, a sheet that has the maximal width, toward the center of the sheet in the widthwise direction.

As shown in FIG. 5, at positions that halve the peripheral portion of the chucking cylinder 13 in the circumferential direction, a plurality of grippers 30 which grip the leading edge of the paper sheet P line up in the axial direction of the chucking cylinder 13. On the peripheral portion of the chucking cylinder 13, a plurality of chuck members 31 which chuck the trailing edge of the paper sheet P line up in the axial direction of the chucking cylinder 13. At positions that halve the peripheral portion of the convertible cylinder 15 in the circumferential direction, a plurality of convertible press mechanisms 33*a* and 33*b* each having grippers 32*a* and 32*b* line up in the axial direction of the convertible cylinder 15.

In this arrangement, when single-sided printing is to be performed, a valve (not shown) is controlled to supply air to the air pipes 19, 20, and 21, and the convertible press mechanism of the convertible cylinder 15 is set in the inoperative state. In this state, when the grippers 30 of the chucking cylinder 13 reach the opposing point X of the convertible cylinder 15, the paper sheet P with the leading edge gripped by the grippers 30 is gripping-changed to the grippers 32*b* of the convertible press mechanisms 33*a* of the convertible cylinder 15. The gripping-changed paper sheet P is conveyed in tight contact with the outer surface of the convertible cylinder 15 by air discharged from the air nozzles 23 and 24. When the grippers 32*b* reach the opposing point of the impression cylinder 7*c*, the paper sheet P gripped by the grippers of the impression cylinder 7*c* is printed in the third color on its obverse surface by the printing unit 3*c*.

When double-sided printing is to be performed, the valve (not shown) is controlled to supply air to the air pipes 19, 20, and 21 and air nozzles 26 and 27. Subsequently, the upstream cylinder group in the sheet convey direction which includes the chucking cylinder 13 is adjusted in phase in the circumferential direction with respect to the convertible cylinder 15 by an angle corresponding to the vertical length of the paper sheet P. Then, the convertible press mechanism is set in the operative state to start printing operation. The paper sheet P with the leading edge gripped by the grippers 30 of the chucking cylinder 13 is conveyed such that the grippers 30 pass through the opposing point X of the chucking cylinder 13 and convertible cylinder 15 and come into contact with the lower side of the outer surface of the chucking cylinder 13.

When the trailing edge of the paper sheet P chucked by the chuck members 31 reaches the opposing point X of the chucking cylinder 13 and convertible cylinder 15, it is gripping-changed to the grippers 32*a* of the convertible cylinder 15. When the convertible cylinder 15 further pivots, both the grippers 32*a* and 32*b* of the convertible press mechanisms 33*a* lie down in the notch of the convertible cylinder 15, and the trailing edge of the paper sheet P is gripping-changed from the grippers 32*a* to the grippers 32*b*. In this state, when the convertible cylinder 15 further rotates, the paper sheet P is released from the grippers 30 of the chucking cylinder 13. Thus, the paper sheet P to be conveyed with its leading edge being gripped by the grippers 32*b* of the convertible cylinder 15 is turned over.

At this time, the air 26*b* and air 27*b* from the blowing ports 26*a* and 27*a* of the air nozzles 26 and 27 are blown toward the center of the paper sheet P at a gap between the outer surface of the chucking cylinder 13 and the paper sheet P which is being separated from the outer surface of the chucking cylinder 13 so as to be turned. Therefore, due to the pressure of the air 26*b* and air 27*b*, the paper sheet P does not come into tight contact with the outer surface of the chucking cylinder 13 but is separated. This operation will be described in detail hereinafter.

The blowing port 26*a* of the air nozzle 26 and the blowing port 27*a* of the air nozzle 27 are set at slightly different horizontal angles. Thus, the air 26*b* from the blowing port 26*a* and the air 27*b* from the blowing port 27*a* are blown out toward two positions on the center in the widthwise direction of the paper sheet P which are shifted from each other by a length "L" in the sheet convey direction. Therefore, first, that portion of the paper sheet P which ranges from the central portion to near the trailing edge in the sheet convey direction is separated from the outer surface of the chucking cylinder 13 by the air 26*b* from the blowing port 26*a*. Then, the trailing edge of the paper sheet P is completely separated from the outer surface of the chucking cylinder 13 by the air 27*b* from the blowing port 27*a*.

The air nozzles 26 and 27 are attached to the frames 25 with no relation to the rotation of the chucking cylinder 13. The blowing times of the air 26*b* and air 27*b* to the paper sheet P thus prolong so that a sufficient quantity of air can be blown. Therefore, the paper sheet P can be reliably separated from the outer surface of the chucking cylinder 13. Accordingly, a gap is reliably formed between the separated paper sheet P and a subsequent paper sheet P. Thus, the sheets do not come into contact with each other, and the printing surfaces of the paper sheets P can be prevented from being damaged.

As the blowing port 27*a* is arranged at a position higher than the blowing port 26*a* by "H", the two air flows, i.e., the air 26*b* and air 27*b* blown out from the outer sides of the two ends of the chucking cylinder 13 toward the center do not collide against each other. The quantity of air blown to the paper sheet P does not become unequal among the two end sides and the central portion in the widthwise direction of the paper sheet P. The paper sheet P thus does not flutter or wave but behaves evenly in the widthwise direction. Consequently, the paper sheet P can be reliably separated from the surface of the chucking cylinder 13, so that damage, rubbing, or wrinkles can be prevented from occurring on the printing surface of the paper sheet P.

Regarding the height difference "H", if the cylinder length of the chucking cylinder 13 is comparatively small, the opposing blowing ports 26*a* and 27*a* are close to each other. In this case, the air 26*b* from the blowing port 26*a* and the air 27*b* from the blowing port 27*a* tend to adversely affect each other readily. To prevent this, the height difference between the blowing ports 26*a* and 27*a* needs to be increased. If the cylinder length of the chucking cylinder 13 is comparatively large, the opposing blowing ports 26*a* and 27*a* are spaced apart from each other. In this case, the air 26*b* from the blowing port 26*a* and the air 27*b* from the blowing port 27*a* less adversely affect each other. Therefore, the height difference between the blowing ports 26*a* and 27*a* can be decreased.

The present inventor repeatedly conducted various experiments by changing the cylinder length of the chucking cylinder 13 and the thickness of the paper sheet P to be conveyed, and confirmed the following fact. That is, when the height difference "H" was set within the range of 10 mm to 70 mm, the paper sheet P could be reliably separated from the chucking cylinder 13 in accordance with the cylinder length and the thickness of the paper sheet P.

The paper sheet P separated from the chucking cylinder 13 and gripped by the grippers 32*b* of the convertible cylinder 15 is regulated from fluttering by the air blown by the air nozzle 22, and then conveyed as it is urged against the outer surface of the convertible cylinder 15 in tight contact by the air discharged from the air nozzles 23 and 24. When the grippers 32*b* reach the opposing point of the impression cylinder 7*c*, the paper sheet P is gripped by the grippers of the impression cylinder 7*c*. Then, the printing unit 3*c* prints the reverse surface of the paper sheet P with the first color.

In the above embodiment, the air nozzles 26 and 27 are attached to the pair of frames 25, but they may be attached to the machine base 16, and various design changes can thus be made. In the above embodiment, a paper sheet is used as the sheet to be conveyed. The sheet can be of any type as far as it is a sheet-type object, e.g., a polyvinyl chloride sheet or film, with an obverse surface that can be printed.

A modification of the air nozzles 26 and 27 described above will be described. In this modification, air nozzles 126 and 127 have variable-height blowing ports 126*a* and 127*a*. Angles α and β in the vertical and horizontal directions of each of the blowing ports 126*a* and 127*a* are variable. As the air nozzles 126 and 127 have similar structures, the structure of the air nozzle 127 will be described hereinafter as a representative.

The air nozzle 127 comprises a proximal-end-side cylindrical member 127*b*, a distal-end-side cylindrical member 127*c*, a cylindrical neck member 127*d*, and an elliptic spherical head member 127*e*. The cylindrical member 127*c* has an outer surface that slides on the inner surface of the cylindrical member 127*b* in the axial direction. The neck member 127*d* has an outer surface that slides on the inner surface of the distal end portion of the cylindrical member 127*c* in the circumferential direction. The head member 127*e* has a rear portion which is supported by the neck member 127*d* to be vertically pivotal. The head member 127*e* also has a blowing port 127*a* at its distal end which discharges air directively.

The cylindrical member 127*c* is moved forward from and backward into the cylindrical member 127*b* to adjust the height of the blowing port 127*a*. After the adjustment, a set screw 141 is fastened to fix the cylindrical member 127*c* to the cylindrical member 127*b*. The cylindrical member 127*b*, cylindrical member 127*c*, and set screw 141 constitute a height adjusting mechanism 128 for the blowing port 127*a*.

The neck member 127*d* is pivoted by the distal end portion of the cylindrical member 127*c* to adjust the angle β of the blowing port 127*a* in the horizontal direction. After the adjustment, a set screw 142 is fastened to fix the neck member 127*d* to the cylindrical member 127*c*. The cylindrical member 127*c*, neck member 127*d*, and set screw 142 constitute a horizontal blowing angle (β) adjusting mechanism.

The head member 127*e* is pivoted about a screw 143 at the rear end portion of the neck member 127*d* as a fulcrum to adjust the angle a of the blowing port 127*a* in the vertical direction. After the adjustment, the screw 143 is fastened to fix the head member 127*e* to the neck member 127*d*. The neck member 127*d*, head member 127*e*, and screw 143 constitute a vertical blowing angle (α) adjusting mechanism.

The set screws 141, 142, and 143 may be omitted if the engaging frictional force between the two members is large.

In place of the height adjusting mechanism 128 with which the operator performs height adjustment manually, an automatically controllable height adjusting device, e.g., an air cylinder having a rod which is movable forward/backward, can be used. In this case, when the thickness of a paper sheet to be conveyed is input, the forward/backward amount of the rod is controlled to automatically adjust the heights of the blowing ports 126*a* and 127*a*.

While a case has been described wherein the height adjusting mechanism comprises the two cylindrical members 127*b* and 127*c* and set screw 141, the present invention is not limited to this. Any structure will do as far as it can adjust the height of the blowing port 127*a* mechanically. The horizontal angle of the head member 127*e* is adjustable with respect to the neck member 127*d*. Alternatively, the neck member 127*d* and head member 127*e* may be integrally formed, and the cylindrical member 127*c* may be formed pivotal in the circumferential direction with respect to the cylindrical member 127*b*, to adjust the horizontal angle. In this case, the cylindrical member 127*b*, cylindrical member 127*c*, and set screw 141 constitute a height/horizontal angle adjusting mechanism. The set screw 142 then becomes unnecessary.

As has been described above, according to the present invention, the direction in which the air blowing means blows air can be held constant with no relation to the rotation of the upstream transport cylinder. Thus, the blowing time of air to the sheet in tight contact with the upstream transport cylinder can be prolonged. Therefore, the sheet which is to be gripping-changed from the upstream transport cylinder to the downstream transport cylinder in the sheet convey direction so as to be turned over can be reliably separated from the surface of the upstream transport cylinder. Since the air blowing means is fixed to the apparatus, a hose or the like to supply air to the air blowing means need not be provided in the cylinder. Thus, the structure of the cylinder does not become complicated.

As the two air blowing means have different heights, the two air flows directed from the outer sides of the two ends of the transport cylinder to the central side do not collide against each other. Thus, the quantity of air blown to the sheet does not become unequal among the two end sides and the central portion in the widthwise direction of the sheet. Consequently, the sheet thus does not flutter or wave but can be separated from the surface of the upstream transport cylinder. Thus, damage, rubbing, or wrinkles can be prevented from occurring on the printing surface of the sheet.

What is claimed is:

1. A sheet-fed offset rotary printing press with a convertible press mechanism, comprising:

an upstream transport cylinder which conveys a sheet by holding a leading edge thereof;

a downstream transport cylinder which is arranged downstream of said upstream transport cylinder in a sheet convey direction and holds a trailing edge of the sheet being conveyed by said upstream transport cylinder;

a convertible press mechanism which causes said downstream transport cylinder to hold the sheet in a turned state when the sheet is to be transferred from said upstream transport cylinder to said downstream transport cylinder; and a pair of air blowing means, arranged at different heights on outer sides of two ends in a widthwise direction of the sheet, for blowing air toward a center in the widthwise direction of the sheet which is turned over by said convertible press mechanism, so as to separate the sheet from said upstream transport cylinder.

2. A press according to claim 1, further comprising a height adjusting mechanism which adjusts a height of an air blowing position of each of said pair of air blowing means.

3. A press according to claim 1, further comprising a horizontal angle adjusting mechanism which adjusts an air blowing angle in a horizontal direction of each of said pair of air blowing means.

4. A press according to claim 1, wherein an air blowing position of each of said air blowing means is arranged to correspond to a triangular sectional region surrounded by three points including an opposing point where said upstream transport cylinder and downstream transport cylinder oppose each other, and contact points, downstream of the opposing point in the sheet convey direction, where said upstream and downstream transport cylinders are in contact with a common tangent L to two outer surfaces thereof, and said pair of air blowing means blow air to a center of the sheet through the triangular sectional region.

5. A press according to claim 4, further comprising a vertical angle adjusting mechanism which adjusts an air blowing angle in a vertical direction of each of said pair of air blowing means.

6. A press according to claim 1, wherein a difference in height between air blowing positions of said pair of air blowing means is set in accordance with a cylinder length of said upstream convey cylinder and a thickness of a paper sheet.

7. A press according to claim 6, wherein a difference in height between the air blowing positions of said pair of air blowing means is set within a range of 10 mm to 70 mm.

8. A press according to claim 1, wherein said pair of air blowing means comprise a pair of air nozzles which are supported by a pair of frames constituting the printing press and have blowing ports with directivity in an air blowing direction.

9. A press according to claim 1, wherein air flows from said pair of air blowing means are blown out toward two positions at a center in the widthwise direction of the sheet which are shifted from each other by a length "L" in the sheet convey direction.

10. A press according to claim 1, further comprising a plurality of first air nozzles arranged in an axial direction of said upstream transport cylinder, wherein the sheet which is turned over by said convertible press mechanism is regulated from fluttering by air blown from said first air nozzles.

11. A press according to claim 10, further comprising a plurality of second air nozzles arranged in an axial direction of said downstream transport cylinder, wherein the sheet which is turned over by said convertible press mechanism is urged against an outer surface of said downstream convey cylinder in tight contact therewith by air blown from said second air nozzles.

* * * * *